US005427005A

United States Patent [19]

Breton

[11] Patent Number: 5,427,005

[45] Date of Patent: Jun. 27, 1995

[54] DEVICE FOR EXTRACTING SAMPLES FROM A FOLDER

[75] Inventor: Richard E. Breton, Rochester, N.H.

[73] Assignee: Heidelberg Harris GmbH, Heidelberg, Germany

[21] Appl. No.: 333,601

[22] Filed: Nov. 2, 1994

Related U.S. Application Data

[60] Continuation of Ser. No. 68,249, May 27, 1993, abandoned, which is a division of Ser. No. 823,673, Jan. 21, 1992, Pat. No. 5,249,493.

[51] Int. Cl.[6] ..... B26D 1/40; B65H 35/08

[52] U.S. Cl. ..... 83/154; 83/103; 83/346; 83/423

[58] Field of Search ..... 83/101, 102, 103, 105, 83/154, 343, 345, 346, 347, 423

[56] References Cited

U.S. PATENT DOCUMENTS

| | | | |
|---|---|---|---|
| 1,816,329 | 7/1931 | Johnston . | |
| 2,318,953 | 5/1943 | Meyer | 83/154 |
| 2,501,835 | 3/1950 | Barber | 83/154 |
| 2,659,437 | 11/1953 | Huck . | |
| 3,008,364 | 11/1961 | Stobb | 83/154 |
| 3,242,781 | 3/1966 | Risica . | |
| 3,247,744 | 4/1966 | Huck . | |
| 3,593,606 | 7/1971 | Raybuck . | |
| 3,999,454 | 12/1976 | Tiso et al. | 83/154 |
| 4,367,069 | 1/1983 | Bishop . | |
| 4,455,736 | 6/1984 | Owen . | |
| 4,501,180 | 2/1985 | Bishop et al. | 83/154 |
| 4,893,534 | 1/1990 | Köbler . | |
| 5,107,733 | 4/1992 | Palmatier et al. . | |

FOREIGN PATENT DOCUMENTS

| | | |
|---|---|---|
| 1227507 | 9/1987 | Canada . |
| 0132763 | 2/1985 | European Pat. Off. . |
| 3704796 | 9/1987 | Germany . |
| 3721515 | 10/1988 | Germany . |
| 2187717 | 9/1987 | United Kingdom . |

*Primary Examiner*—Scott A. Smith

*Attorney, Agent, or Firm*—Herbert L. Lerner; Laurence A. Greenberg

[57] ABSTRACT

A device for extracting samples from a folder, includes a cutting cylinder pair including a blade cylinder and a grooved cylinder, the blade cylinder having at least one cutting blade mounted on the periphery thereof, the grooved cylinder having at least one groove bar, a respective holding device for signatures assigned to the groove bar, conveyor tapes for conveying signatures emerging from a nip between the blade cylinder and the grooved cylinder of the cutting cylinder pair to a signature delivery and to a conveyor unit assigned to the cutting cylinder pair, and a device for remotely controlling the holding devices.

8 Claims, 8 Drawing Sheets

DEVICE FOR EXTRACTING SAMPLES FROM A FOLDER

Figure 1:
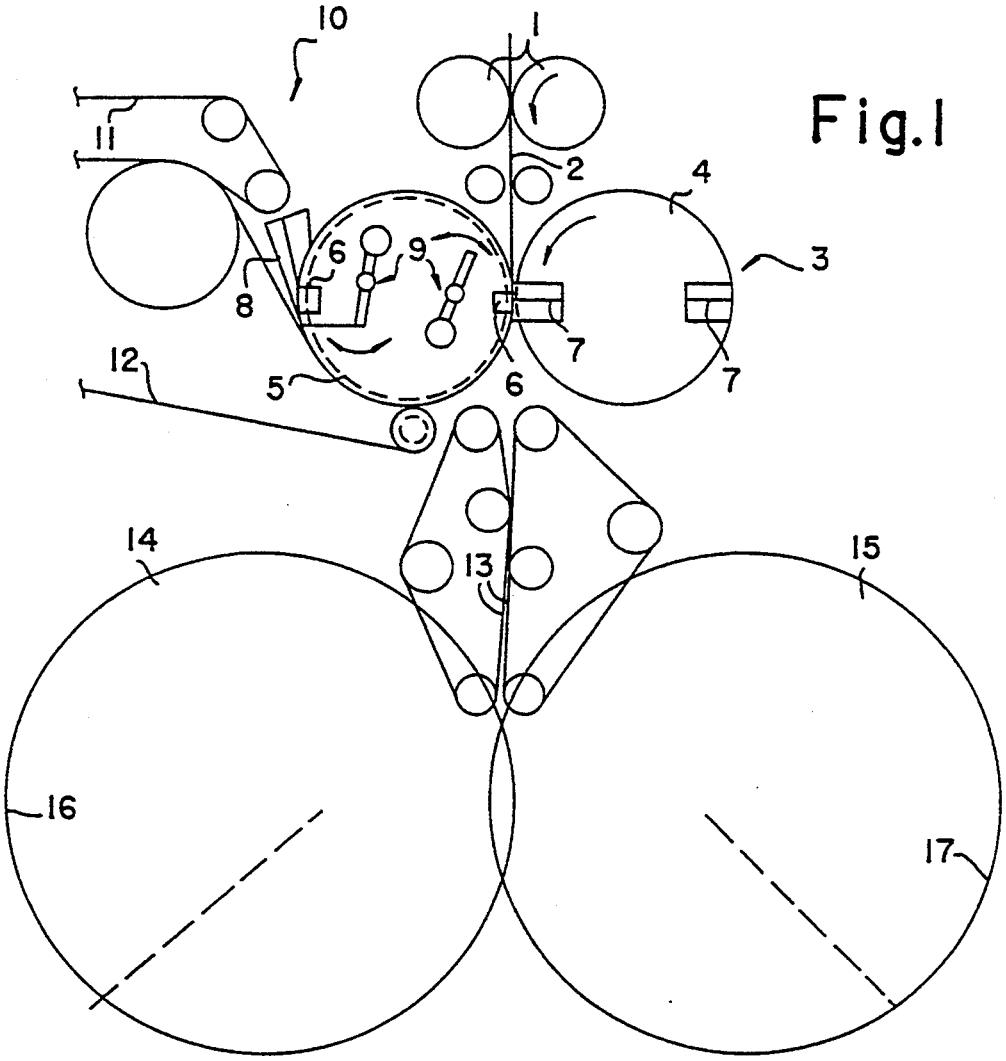

This application is a continuation of application Ser. No. 08/068,249, filed May 27, 1993, now abandoned, which is a division of application Ser. No. 07/823,673, filed Jan. 21, 1992, now U.S. Pat. No. 5,249,493.

SPECIFICATION

The invention relates to a device for extracting signature samples in a folder of a printing machine.

From German Patent 37 21 515, a device has become known heretofore for diverting or distributing signatures. Pairs of wings arranged as deflecting elements on a cutting-cylinder pair exhibit varying elasticity and rigidity, respectively. Due to the effect of a respectively more-rigid wing on a signature, the latter is deflected into one of two conveying paths. This known device thus serves to divert or divide a signature stream into different conveying paths by deflecting the leading edge of the respective signatures.

It has also become known heretofore from U.S. Pat. No. 3,593,606, to arrange impaling pins in a grooved cylinder of a cutting-cylinder pair for impaling and fixing a paper web running into the cutting-cylinder pair. The impaling pair are arranged within a given angular range with respect to the paper web, and ensure that, within the movement of the paper web in a direction towards the grooved cylinder, a movement which is caused by the cutting operation, the impaling holes will not be enlarged into slots, which would otherwise impede subsequent processing. The impaling pins act upon every paper-web section running into the cutting-cylinder pair and grip them. With this heretofore known device, it is possible only to grip the paper web which is to be processed, and no ability to separate individual signatures is provided.

Starting from the aforedescribed state of the art, it is an object of the invention to provide a device for extracting signature samples in a folder without impairing normal printing-machine operation.

With the foregoing and other objects in view, there is provided, in accordance with the invention, a device for extracting samples from a folder, comprising a cutting cylinder pair including a blade cylinder and a grooved cylinder, the blade cylinder having one or more cutting blades mounted on the periphery thereof, the grooved cylinder having a number of groove bars corresponding to the number of the cutting blades, a respective holding device for signatures assigned to the respective one or more groove bars, conveyor tapes for conveying signatures emerging from a nip between the blade cylinder and the grooved cylinder of the cutting cylinder pair to a signature delivery and to a conveyor unit assigned to the cutting cylinder pair, and means for remotely controlling the holding devices.

The advantages of the construction according to the invention is that the extraction of samples from the running printed-product flow can be instituted by remote control without reducing the machine speed. Quality controls can be practiced on the samples. The samples are introducible into a separate conveyor unit. Due to this construction, it is possible to provide a casing of the folder which encompasses further processing stations such as stacking devices, stitching or binding devices and the like. Due to the sampling and the control of these signatures, corrections can be made quite early, especially during the start-up phase, which contributes to waste reduction. The remote-control capability of the device for extracting samples in accordance with the invention permits further automatization of the folder.

In this regard, it is possible, when irregularities in operation or signature jams occur, to guide the routine or running production out of the printing machine by means of the conveyor unit assigned to the cutting-cylinder pair without having to stop production. The difficult ink/dampening-medium emulsion present on the printing form and on the cylinder dressings or packing is maintained there and, after the removal of the disturbance, a transition may be made immediately to normal production speed.

In accordance with another feature of the invention, the device includes a solenoid and an armature operatively engageable and disengageable with the holding device for signatures for electromagnetically blocking and releasing the holding device.

It is possible thereby to effect an intended remotely controllable actuation of the holding devices. During the start-up phase, sample signatures can be extracted from the routine production at selective timely intervals, which may be stored in memory, and checked for the quality thereof. In the case of a longer actuation of the solenoid, the entire production stream can be conducted through the holding devices by the conveyor unit assigned to the cutting-cylinder pair.

In accordance with a further feature of the invention, a plurality of the holding devices corresponding to the plurality of the cutting blades are mounted in the grooved cylinder, each of the holding devices being assigned to a respective one of the cutting blades.

This type of construction offers the opportunity to take into account the confined or narrow spatial relationships in the folder as well as the possibility of retrofitting previously delivered printing machines.

In accordance with an added feature of the invention, the device includes ring-shaped coverings fastened to the peripheral surface of the grooved cylinder in uniformly spaced relationship from one another in axial direction of the grooved cylinder.

This provides the advantageous effect that the signatures, which are to be extracted from the routine product stream, are so deeply impaired by the extensible impaling pins that they remain fixed to the peripheral surface of the respective cylinder of the cutting-cylinder pair until they run into the conveyor unit. The leading edge of the sample signature thus cannot become loosened, and assurance is provided that the gripped sample signature will run into the conveyor unit at the cutting-cylinder pair.

In accordance with an additional feature of the invention, each of the holding devices comprises a plurality of impaling pins spaced from one another in axial direction of the grooved cylinder and displaceable between a first position within the grooved cylinder and a second position beyond the outer cylindrical surface of the grooved cylinder.

In accordance with yet another feature of the invention, the device includes electromagnetically actuatable control means for controlling the: displacement of the plurality of impaling pins between the first and second positions thereof. In accordance with yet a further feature of the invention, the control means comprise a control cam, a follower roller guidable on the control cam, a pivotable control lever carrying the follower roller and pivotable in accordance with the guidance of the follower roller by the control cam, spring means engaging with the control lever for maintaining the follower roller in contact with the control cam, and means connecting the plurality of impaling pins with the pivotable control lever for pivoting the plurality of impaling pins into the first and second positions thereof is accordance with the guidance of the followers roller by the control cam.

In accordance with yet an added feature of the invention, the holding devices comprises means defining a plurality openings formed in the outer cylindrical surface of the grooved cylinder, the openings being connectible with a vacuum source for holding a respective signature against the grooved cylinder b suction, and being connectible with a source of blowing air for releasing and transferring the signature.

In accordance with an alternate feature of the invention, each of the holding devices comprises means defining a plurality of openings formed in the outer cylindrical surface of the grooved cylinder, the openings being connectible with a vacuum source for holding a respective signature against the grooved cylinder by suction, and including means for stripping the respective signature from the grooved cylinder.

In accordance with yet an additional feature of the invention, the device includes a control shaft mounted in the grooved cylinder, the impaling pins being pivotally carried by the control shaft, and a pneumatically-operated adjusting cylinder mounted on an end face of the grooved cylinder and having a piston operatively connected to the control shaft for pneumatically extending and retracting the impaling pins into the first and second positions thereof.

In accordance with a concomitant feature of the invention, the device includes a control shaft mounted in the grooved cylinder, the impaling pins being pivotally carried by the control shaft, and wherein the electromagnetically actuatable control means comprise a pair of solenoids having respective armatures actuatable for enabling the impaling pins of the respective holding devices to retract to the first position thereof, the first position being in the vicinity of one of the groove bars, and for extending the impaling pins beyond the outer cylindrical surface of the grooved cylinder for extracting a signature sample.

Other features which are considered as characteristic for the invention are set forth in the appended claims.

Although the invention is illustrated and described herein as embodied in a device for extracting samples from a folder, it is nevertheless not intended to be limited to the details shown, since various modifications and structural changes may be made therein without departing from the spirit of the invention and within the scope and range of equivalents of the claims.

Figure 1A:
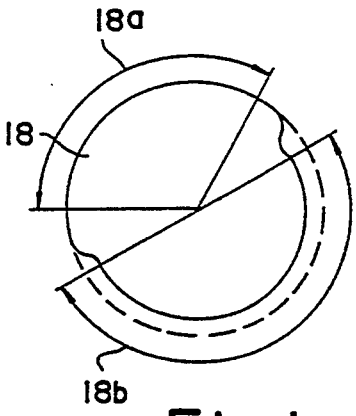
Figure 1B:
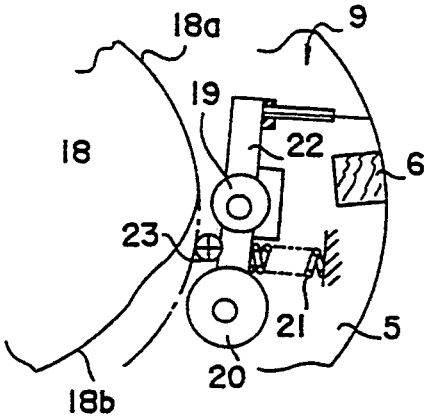

The construction and method of operation of the invention, however, together with additional objects and advantages thereof will be best understood from the following description of specific embodiments when read in connection with the accompanying drawings, in which:

FIG. 1 is a diagrammatic front elevational view of a device for extracting samples of signatures in a folder, together with a conveyor and delivery unit;

FIG. 1*a* is a diagrammatic view of a control cam for a holding device forming part of the invention of FIG. 1;

FIG. 1*b* is an enlarged fragmentary view of FIG. 1 showing the holding device controlled by the control cam of FIG. 1*a;*

Figure 1C:
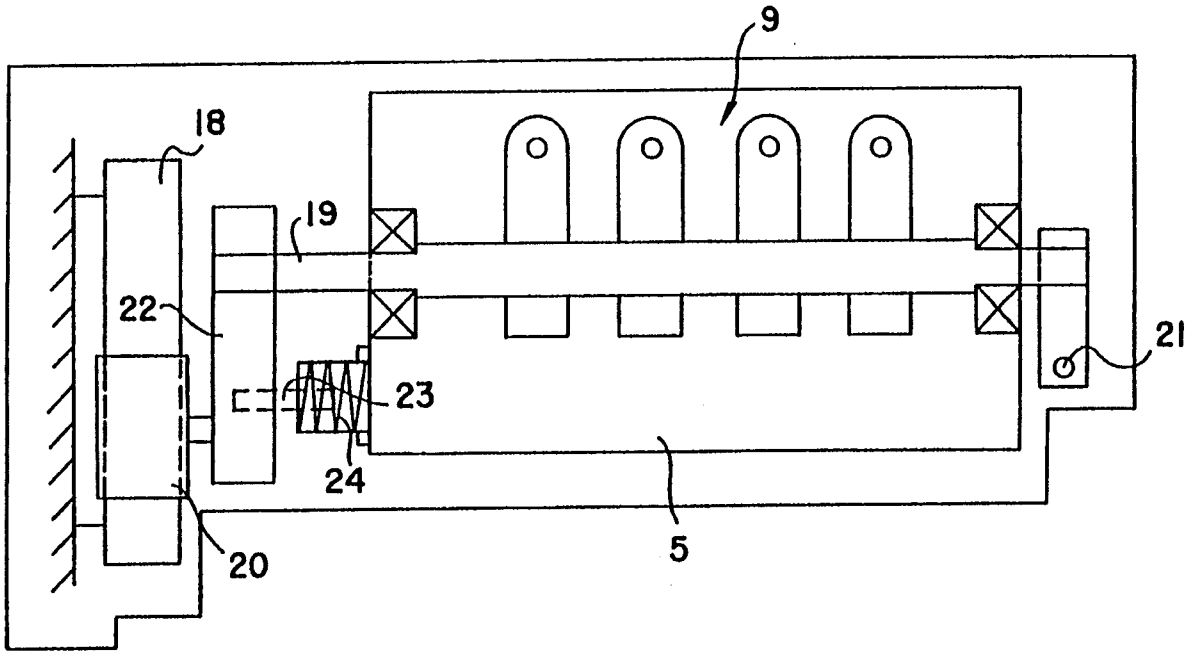
Figure 2:
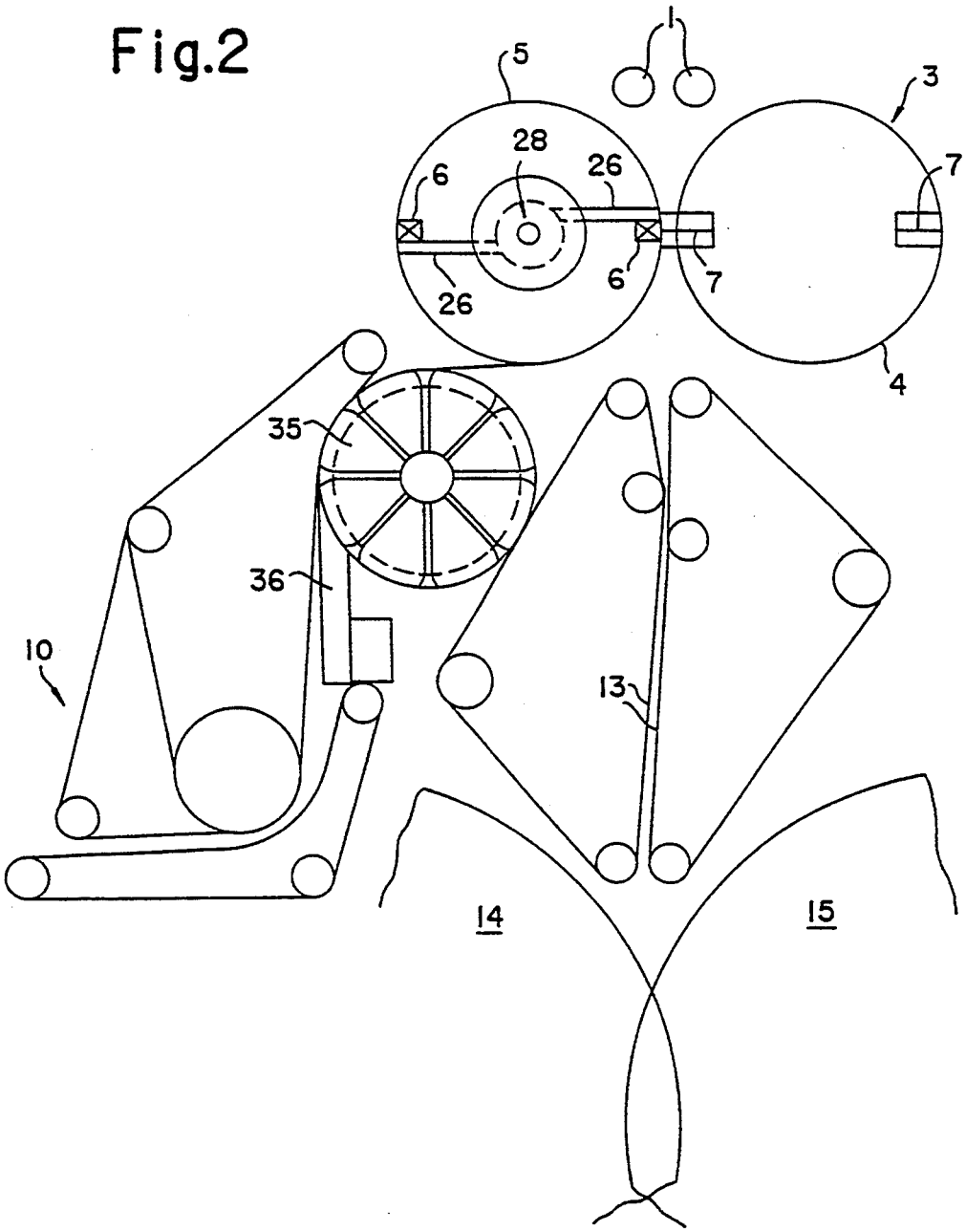
Figure 2A:
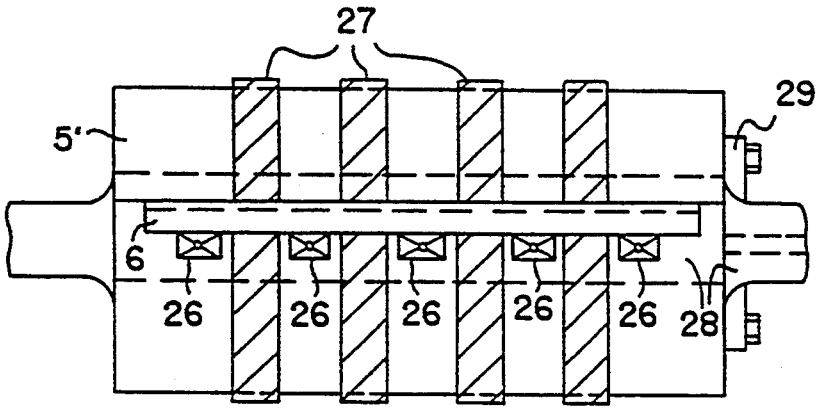
Figure 2B:
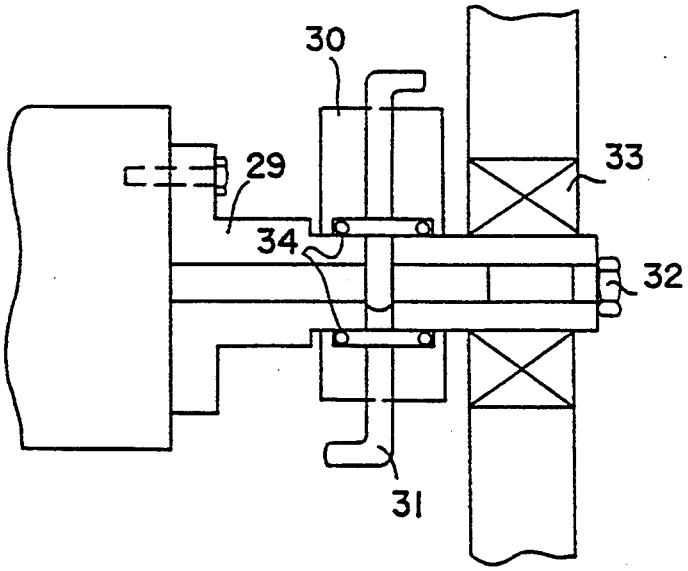
Figure 3A:
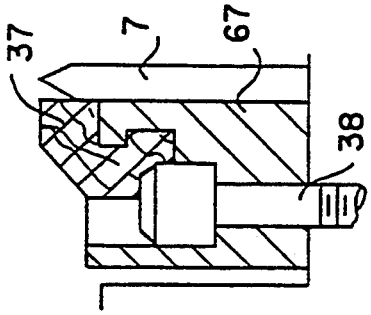
Figure 3:
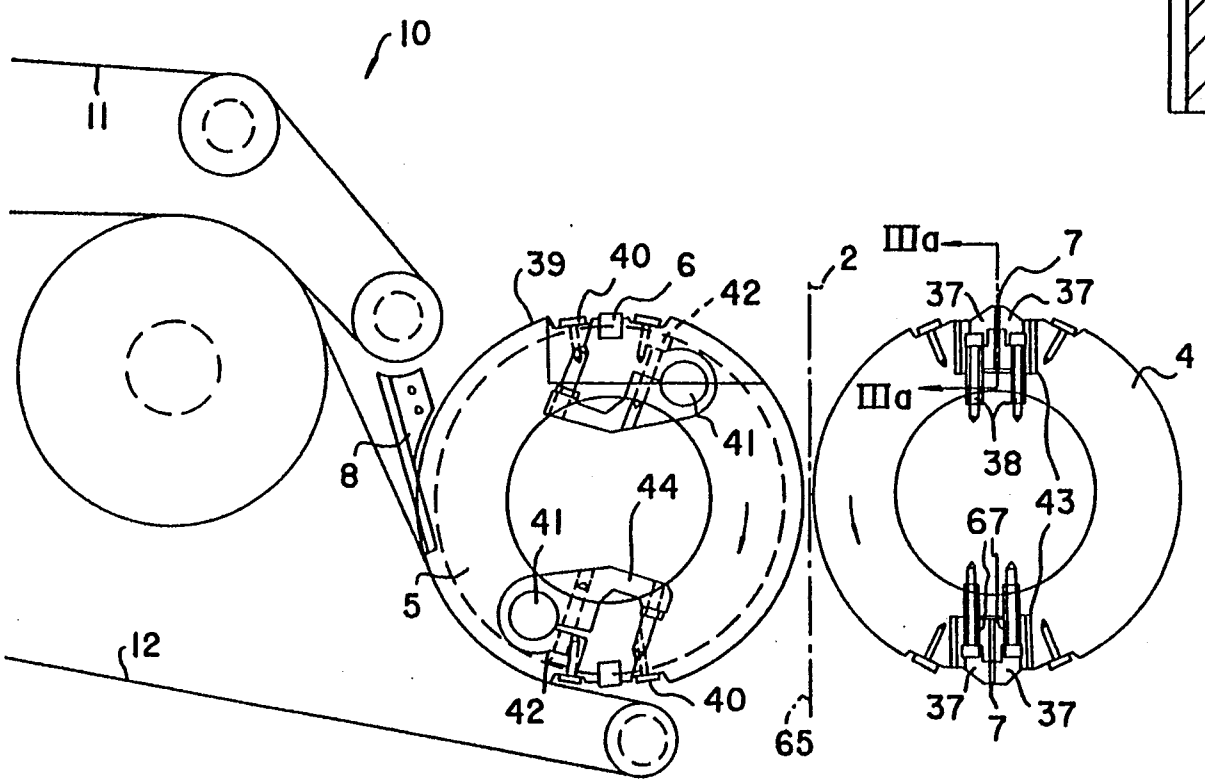

FIG. 1*c* is a fragmentary enlarged diagrammatic side elevational view of FIG. 1 showing a grooved cylinder forming part of a cutting-cylinder pair according to the invention;

FIG. 2 is a view like that of FIG. 1 of another embodiment of the invention wherein the sample extraction device is provided with a grooved cylinder having suction openings formed in the outer cylindrical surface thereof;

FIG. 2*a* is a fragmentary side elevational view, partly in section, of FIG. 2 showing the grooved cylinder thereof;

FIG. 2*b* is a view like that of FIG. 2*a* showing only part of the grooved cylinder to which air connectors are attached;

FIG. 3 is a slightly modified enlarged fragmentary view of FIG. 1 showing the cutting cylinder pair in greater detail, together with the conveyor unit assigned thereto for transporting sample signatures;

FIG. 3*a* is an enlarged fragmentary cross-sectional view of

FIG. 3 taken in the direction of the arrows III*a*—III*a;*

Figure 4A:
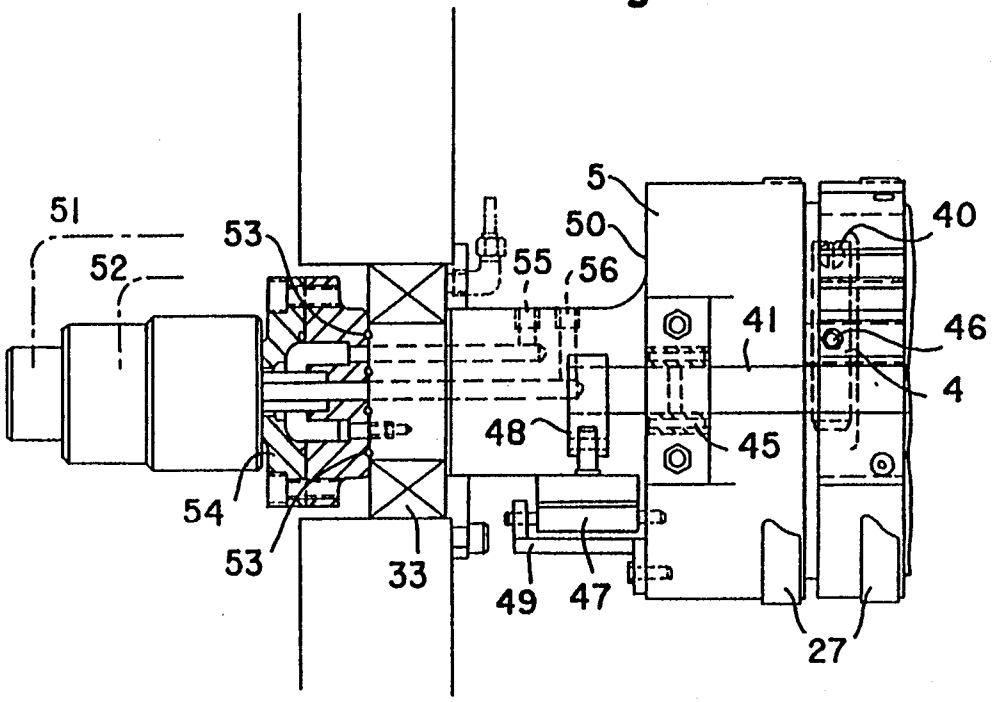
Figure 4B:
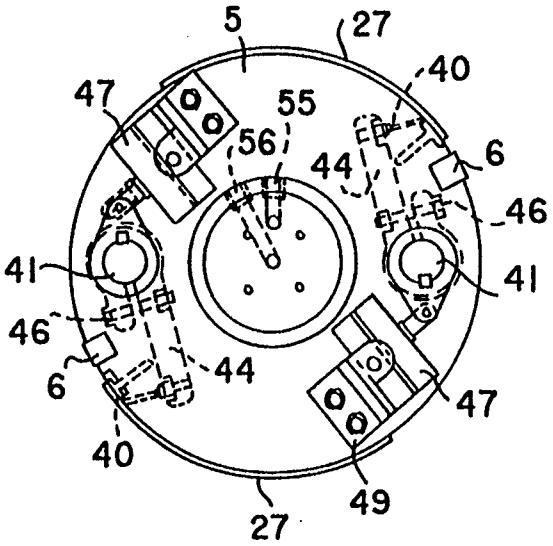
Figure 5A:
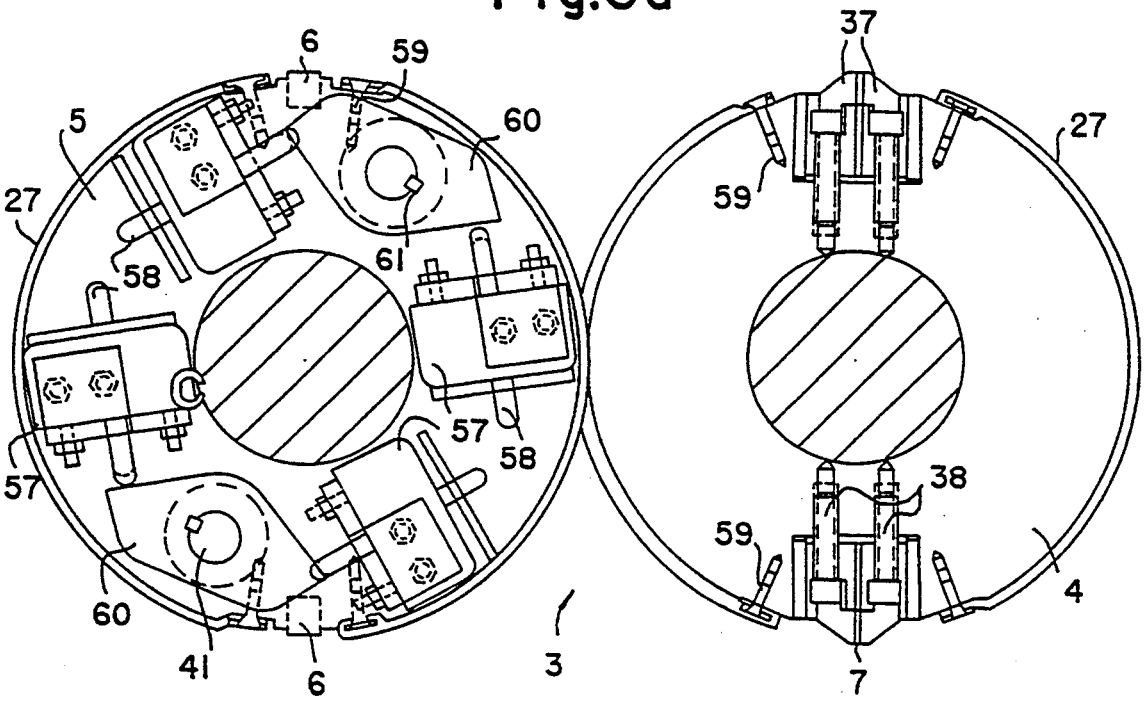
Figure 5B:
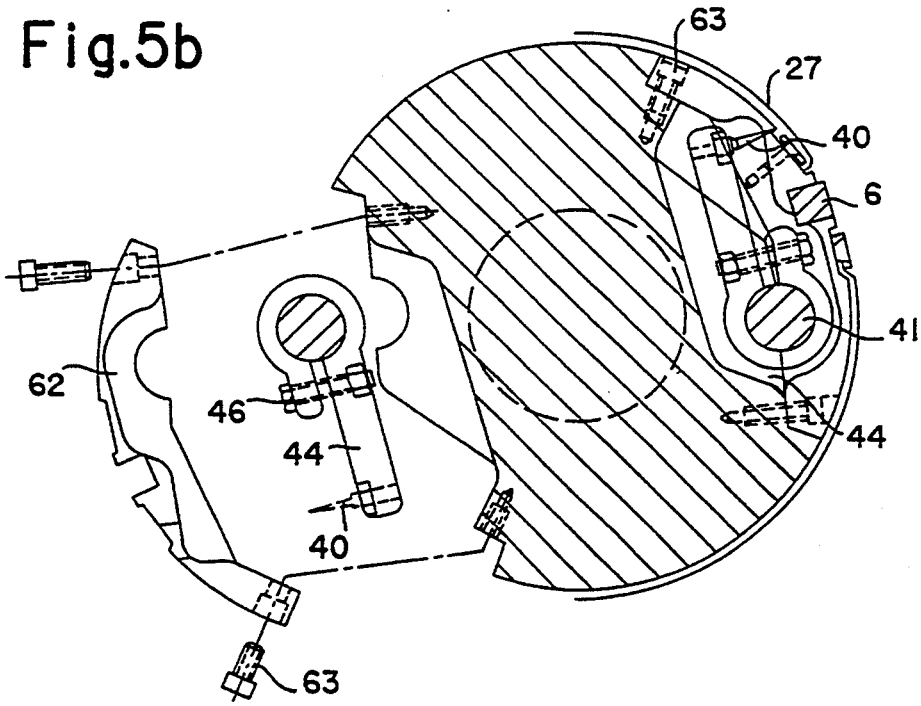

FIGS. 4*a* and 4*b* are, respectively, side and end elevational views of the grooved cylinder with pneumatically actuated adjusting cylinders;

FIG. 5*a* is an enlarged fragmentary view of FIG. 3 showing the cutting cylinder pair with a grooved cylinder having electromagnets for actuating holding devices thereon;

FIG. 5*b* is an exploded view of the grooved cylinder of FIG. 5*a*; and

Figure 5C:
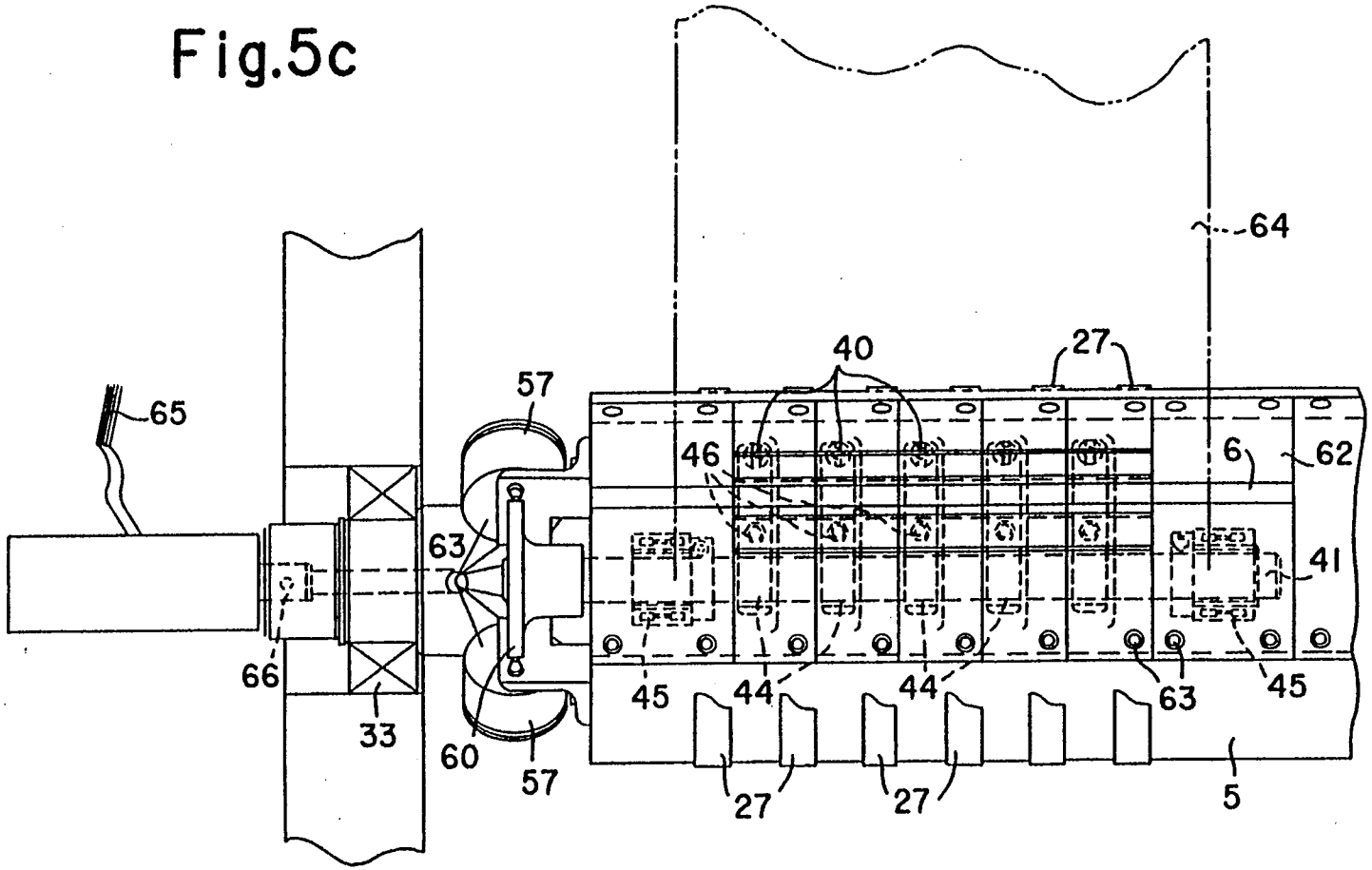

FIG. 5*c* is a top plan view of the grooved cylinder of FIGS. 5*a* and 5*b*.

Referring now to the drawing and, first, particularly to FIG. 1 thereof, there is shown therein diagrammatically the construction of a folder or folding apparatus incorporating the device for extracting sample signatures according to the invention. After a paper web 2 has passed through a nip between a pair of draw rollers 1, it enters a nip between a pair of cutting cylinders 3 which include a blade cylinder 4 and a grooved cylinder 5. As shown in FIG. 1, the blade cylinder 4 has two cutting blades 7 mounted at the periphery thereof. It is also possible, obviously, to arrange one or more than two cutting blades 7 on the blade cylinder 4. The blade cylinder 4 cooperates with the grooved cylinder 5 which has two groove bars 6 embedded in the periphery thereof. Reference is made to FIGS. 3 and 5*a* which show how the cutting blades 7 are mounted.

In the grooved cylinder 5, two holding devices 9 are mounted which are disposed opposite one another. The holding devices 9, when actuated, can swing out beyond the outer cylindrical, surface of the grooved cylinder 5, grip the leading edge of the paper web 2 and fix it onto the peripheral surface of the grooved cylinder 5. A web section fixed on the grooved cylinder 5 is removed from the peripheral surface of the grooved cylinder 5 by a stripper 8 starting with the leading edge of the web section, and travels to conveyor belts or tapes 11 and 12 of a conveyor unit 10 assigned to the cutting-cylinder pair 3. To guide the severed web section fixed to the peripheral surface of the grooved cylinder 5, the conveyor belt or tape 12 surrounds a sector of the outer cylindrical surface of the grooved cylinder 5.

It is, of course, also possible to conduct several web sections, i.e., printed products or signatures, into the conveyor unit 10 in succession by actuating the holding devices 9. If no printed products or signatures are guided or directed into the conveyor unit 10, they continue instead on their original downward path, as shown in FIG. 1, into the conveyor tapes 13 which feed them to conventional delivery fans or paddle wheels 14 and 15 shown diagramatically in FIG. 1. As is apparent from FIG. 1, the peripheries 16 and 17 of the delivery fans or paddle wheels 14 and 15 intersect. This signifies that the individual fan blades or paddles forming the respective fans or paddle wheels 14 and 15 are arranged offset from one another on the respective support shafts, and an overlapping of the two peripheries therefore results. The conveyor tapes 13 guide the signatures into the section region described by the peripheries 16 and 17 and, depending upon which delivery fan pocket the respective signatures meet, the signatures will either end up in the delivery fan 14 or the delivery fan 15.

Details of the actuating mechanism for the holding device 9 are illustrated in FIGS. 1*a*, 1*b* and l*c*. FIG. 1*a* shows the contours of a control cam 18 having in essence two cam segments 18*a* and 18*b*, due to which a control or follower roller 20 is reciprocable. The cooperation of the cam segments 18*a* and 18*b* is apparent from FIG. 1*b* in which there is shown how the control roller or follower 20 rolling on the cam segments 18*a* and 18*b* moves a control lever 22 about a pivot shaft 19. Engagement of the control or follower roller 20 with the cam 18 is effected by a compression spring 21 which forces the control lever 22 to pivot about the pivot shaft 19 and into contact with the cam 18. The follower roller 20 thereby follows the profile of the control cam 18. If the control lever 22 is latched or locked by a plunger or armature 23 of a magnetic coil or solenoid 24 (FIG. 1*c*), the follower roller 20 is stopped from contacting a part of the control cam 18. The control lever 22 is accordingly latched or locked in the position illustrated in. FIG. 1*b*. The plunger can be extended only while the roller is on the cam portion 18A. The holding device 9 remains driven into the interior of the grooved cylinder 5.

As is apparent from FIG. 1*c*, the coil core or armature 23 is extended and retracted by appropriate energization of the solenoid or magnetic coil 24. If the armature 23 is withdrawn into the solenoid 24, the control lever 22 is unlatched or released and follows the movement constrained by the contour of the cam 18. The holding devices 9 extend outwardly, the instant the follower roller 20 starts to roll onto the cam segment 18*b*, and release the printed product or signature immediately before it reaches the stripper 8, when the control lever 22 is again turned due to the cam segment 18*a*, and the holding devices 9 are again retracted inwardly into the exterior by the grooved cylinder 5. The spatial arrangement of the mechanism for actuating the holding device 9 can be formed of a multiplicity of extensible impaling pins 40 (note: FIG. 3) mounted mutually adjacently on the pivot shaft 19, the pins being retracted and extended by the control lever 22 turnable by the control or follower roller 20.

In the embodiment according to FIG. 2, there is shown a device for extracting sample printed products or signatures having a cylinder 5 of a cutting-cylinder pair 3' with suction openings 26 formed in the outer cylindrical surface thereof. The cutting-cylinder pair 3' made up the blade cylinder 4' and the grooved cylinder 5' is located below the nip or draw-roller pair 1. The groove bars 6 are mounted in the groove cylinder 5', and cutting blades 7 are built into the blade cylinder 4'. Conveyor belts or tapes 13 are provided below the cutting-cylinder pair 3', and convey a flow of products to delivery fans 14 and 15 from the cutting-cylinder pair 3'.

The suction openings 26 formed in the grooved cylinder 5' are in communication with an air or suction channel 28 extending axially through the grooved cylinder 5'. The suction openings 26 are located in the vicinity of the groove bars 6, as is clearly shown in FIG. 2*a*. Moreover, the grooved cylinder 5' is provided with a covering 27. The air or suction channel 28 is formed in a flange 29 which simultaneously serves as a journal for the grooved cylinder 5'. As is apparent from FIG. 2*b*, the journal 29 of the grooved cylinder 5' is received in a cylinder bearing 33. A vacuum connection 30 and a blowing or blast air connector 31 are mounted on the journal 29 and provide means via which the air or suction channel 28 can be supplied with vacuum or blast air. The vacuum connection 30 and the blast air connection 31 communicate through sealing rings 34 with openings of the suction-air channel 28. In lieu of the blast air connection 31, a suitable mechanical stripper 31', shown diagrammatically in FIG. 2, may be provided for stripping the signatures from the grooved cylinder 5' and directing them to the conveyor belts or tapes 13. In accordance with the demand or requirements for test samples, the sucking of a sample as well as its further delivery to a transport cylinder 35 is induced or initiated. The latter has an outer cylindrical surface which is also formed with suction air openings and likewise connected to a vacuum connection.

The blast air which can be introduced into the grooved cylinder 5' permits the transfer of a test sample to the transport cylinder 35, which at this instant of time is connected to the vacuum system of the printing machine, in order to take over the sample. The test sample is transported on the peripheral surface of the transport cylinder 35 until it is removed by a stripper 36 from the transport cylinder 35 and further conducted to the conveyor unit 10. This possible construction for extracting a test sample can be combined with the hereinafore-described holding devices 9.

FIG. 3 is a slightly modified enlarged fragmentary view of FIG. 1 and shows the cutting-cylinder pair 3 with the conveyor unit 10 for test samples assigned thereto. The cutting blades 7 are fixed by two lug strips or mounting bars 67, which are fastened by clamping screws 38 in a recess 43 formed in the blade cylinder 4, while simultaneously retaining compressible soft cheekwoods 37 therein, as further shown in FIG. 3*a*. The impaling pins 40 are built into the grooved cylinder 5 in the vicinity of the mutually opposite groove bars 6, and are pivotable with levers 44 by respective adjusting shafts 41. The levers 44 are fixable by respective clamping screws 42 to the adjusting shafts 41. The depth of puncture by the impelling pins 40 can be varied by suitably pivoting the respective levers 44 on the shaft 41. When actuating the device for extracting samples in accordance with the invention, after the paper web 2 has been cut between the groove bars 6 and the cutting blades 7, the leading section of the resulting printed product or signature is then punctured and thus fixed on the outer cylindrical surface 39 of the grooved cylinder 5, is removed by the stripper 8, and is guided into the conveyor unit 10. Through the next contact between the groove bars 6 and the cutting blades 7, for example after half a rotation of the blade cylinder 4 and the grooved cylinder 5, the leading section of the paper web 2 is cut and, upon demand or requirement, a further leading edge of the paper web 2 is punctured or impaled by the impaling pins 40 and is extracted as a test sample.

FIGS. 4*a* and 4*b* are side and end elevational views of a grooved cylinder 5″ with pneumatically actuated adjusting cylinders 47.

In the grooved cylinder 5″, the adjusting shaft 41 is supported by an adjusting-shaft bearing 45. The adjusting shaft 41 carries the levers 44 which are fastened by respective clamping screws 46 on the adjusting shaft 41. The impaling pins 40 are fastened to a forward part of the respective levers 44. At an end face 50 of the grooved cylinders 5″, an adjusting cylinder 47 is received in a holder 49 and acts upon the adjusting shaft 41 via an adjusting lever 48.

In a journal of the cylinder 5″, adjusting-cylinder connections or unions 55 and 56 are provided with which the adjusting cylinder 47 is connectible. Diagrammatically illustrated air unions 51 and 52 extend through a cover 54 and through sealing rings 53 to the adjusting-cylinder connections 55 and 56.

FIG. 4*b* illustrates the end face 50 of the grooved cylinder 5″. The spatial arrangement of all of the components is apparent from this view. The impaling pins 40, as they swing outwardly, pass beyond the outer cylindrical surface of the grooved cylinder 5″ in the vicinity of the groove bars 6. The covering 27 is fixed to the outer cylindrical surface of the grooved cylinder 5 with the aid of non-illustrated clamping screws. Through the releasable connection between the impaling pins 40 and the levers 44, it is possible to install longer or shorter pins in the levers 44. The adjusting cylinders 47 are movably mounted in the holders 49 for achieving motion equalization or balance during the adjustment process.

FIGS. 5*a*, 5*b* and 5*c* show a grooved cylinder 5″ with electromagnetically actuatable holding devices. In this regard the cutting-cylinder pair 3 is shown in FIG. 5*a*. The covering 27 on the peripheral surface of the blade cylinder 4′ is fastened by the clamping screws 59. The clamping screws 38 serve for fastening the lug strips 67 so as to retain the compressible cheekwoods 37, as in the embodiment of FIGS. 3 and 3*a*. In the grooved cylinder 5‴, two electromagnets 57 are assigned, respectively, to a swivel member 60. Each of these electromagnets 57 has a pin 58 which engages one of the swivel members 60. The latter is seated, at the outside, on the shaft 41 and guides the swivel movement, released by inward and outward travel, respectively, of the pins 58 in the electromagnets or solenoids 57, via a key 61 into the adjusting shaft 41, on which the individual levers 44 are supported.

FIG. 5*b* is a cross-sectional view of the grooved cylinder 5‴. The adjusting shaft 41 carries the levers 44 which are fastened by clamping screws 46. The adjusting shaft 41 is received in a split bearing formed of the grooved cylinder 5‴ and a cover 62 which is fastened by screws 63 to the grooved cylinder 5.

FIG. 5*c* is a top plan view of the grooved cylinder 5‴ actuatable by electromagnets or solenoids 57. The adjusting shaft 41 is supported in adjusting-shaft bearings 45 in the grooved cylinder 5‴. Electromagnets or solenoids 57 are fastened at the outside, in the vicinity of the cylinder bearing 33, and act upon the swivel member 60 on the adjusting shaft 41. Behind the grooved cylinder 5‴, a printed product or signature 64 is shown in phantom. Connecting lines 65 extend into the bearing journal of the grooved cylinder 5‴ and are routed through a channel 66 to the electromagnets or solenoids 57. The individual covers 62, as well as the screws 63 thereof, as well as the clamping screws 46 of the levers 44 are shown on the peripheral surface of the grooved cylinder 5‴.

With the hereinafore-described remote-control systems, a test product or sample extraction actuatable from the printing-machine control is possible, on demand, for quality control during the operation of the machine. The extraction of test samples is of special interest during the start-up phase of operation, in order, if necessary, to be able to effect corrections at that time.

What is claimed is:

1. Device for selectively extracting samples from a folder, comprising a cutting cylinder pair including a plurality of cutting blades and a plurality of groove bars, a blade cylinder and a grooved cylinder having a signature-supporting outer cylindrical surface, said blade cylinder carrying all of said cutting blades on a periphery thereof, said grooved cylinder carrying all of said groove bars, a holding device for signatures assigned to at least one of said groove bars, means for selectively conveying signatures emerging from a nip between said blade cylinder and said grooved cylinder of said cutting cylinder pair in a first path to a signature delivery and in a second path to a conveyor unit assigned to said cutting cylinder pair, said conveying means to said conveyor unit comprising the signature-supporting outer cylindrical surface of said grooved cylinder, means for removing the signature from the surface of said grooved cylinder, and means for remotely controlling said holding device.

2. Device according to claim 1, including ring-shaped coverings fastened to the peripheral surface of said grooved cylinder in uniformly spaced relationship from one another in axial direction of said grooved cylinder.

3. Device according to claim 1, wherein said means for removing the signatures from the surface of said grooved cylinder comprise a stripper mounted adjacent said grooved cylinder.

4. Device for selectively extracting samples from a folder, comprising a cutting cylinder pair including a plurality of cutting blades and a plurality of groove bars corresponding to said plurality of said cutting blades, a blade cylinder and a grooved cylinder having a signature-supporting outer cylindrical surface, said blade cylinder carrying all of said plurality of cutting blades on a periphery thereof, said grooved cylinder carrying all of said plurality of groove bars, a holding device for signatures assigned to each of said groove bars, means for selectively conveying signatures emerging from a nip between said blade cylinder and said grooved cylinder of said cutting cylinder pair in a first to a signature delivery and in a second path to a conveyor unit assigned to said cutting cylinder pair, said conveying means to said conveyor unit comprising said signature-supporting outer cylindrical surface of said grooved cylinder, means for removing the signature from the surface of said grooved cylinder and means for remotely controlling said holding devices.

5. Device according to claim 4, wherein a plurality of said holding devices corresponding to said plurality of said cutting blades are mounted in said grooved cylinder, each of said holding devices being associated with a respective one of said cutting blades.

6. Device according to claim 4, wherein each of said holding devices comprises a plurality of impaling pins spaced from one another in axial direction of said grooved cylinder and displaceable between a first position within said grooved cylinder and a second position beyond the outer cylindrical surface of said grooved cylinder.

7. Device according to claim 6, wherein said controlling means comprise a control cam, a follower roller guidable on said control cam, a pivotable control lever carrying said follower roller and pivotable in accordance with the guidance of said follower roller by said control cam, spring means engaging with said control lever for maintaining said follower roller in contact with said control cam, means for permanently disengaging said follower roller of said control lever from said control cam, and means connecting said plurality of impaling pins with said pivotable control lever for pivoting said plurality of impaling pins into said first and second positions thereof is accordance with the guidance of said followers roller by said control cam.

8. Device according to claim 4, wherein said means for removing the signatures from the surface of said grooved cylinder comprise a stripper mounted adjacent said grooved cylinder.

* * * * *